US011767840B2

(12) United States Patent
Brocker et al.

(10) Patent No.: US 11,767,840 B2
(45) Date of Patent: Sep. 26, 2023

(54) DIAPHRAGM PUMP

(71) Applicant: Ingersoll-Rand Industrial U.S., Inc., Davidson, NC (US)

(72) Inventors: Daniel Brocker, Cornelius, NC (US); Mark Anthony Ezzo, Troutman, NC (US); James Gregory Simmons, Mooresville, NC (US); Jeremy S. Ferden, Mooresville, NC (US)

(73) Assignee: INGERSOLL-RAND INDUSTRIAL U.S., Davidson, NC (US)

( * ) Notice: Subject to any disclaimer, the term of this patent is extended or adjusted under 35 U.S.C. 154(b) by 0 days.

(21) Appl. No.: 17/156,766

(22) Filed: Jan. 25, 2021

(65) Prior Publication Data

US 2022/0235757 A1 Jul. 28, 2022

(51) Int. Cl.

| | |
|---|---|
| ***F04B 43/02*** | (2006.01) |
| ***F04B 45/04*** | (2006.01) |
| ***F04B 45/053*** | (2006.01) |

(52) U.S. Cl.

CPC ..... *F04B 45/053* (2013.01)

(58) Field of Classification Search

CPC ..... F04B 43/02; F04B 45/04; F04B 43/0009; F04B 43/0054; F04B 43/0036; F04B 43/0027; F16J 3/02

USPC ..... 92/100

See application file for complete search history.

(56) References Cited

U.S. PATENT DOCUMENTS 2,364,111 A 12/1944 Tucker
2,685,304 A * 8/1954 Wright ..... F04B 43/009 92/100
2,751,850 A * 6/1956 Hoover ..... F04B 43/009 92/100
3,276,389 A * 10/1966 Bower, Jr. ..... F01L 23/00 417/339
3,354,831 A * 11/1967 Acker ..... F04B 43/026 417/387
3,386,388 A 6/1968 Rosenberg
4,050,861 A 9/1977 Sakai et al.

(Continued)

FOREIGN PATENT DOCUMENTS

DE 4310062 A1 9/1994
DE 19904350 A1 8/2000

(Continued)

OTHER PUBLICATIONS

Full Machine Translation of French Patent FR 2934332 A1 to Lefebvre, retrieved from espaceneton Dec. 10, 2021 (Year: 2021).*

(Continued)

*Primary Examiner* — Philip E Stimpert

*Assistant Examiner* — Dnyanesh G Kasture

(74) *Attorney, Agent, or Firm* — Edell, Shapiro & Finnan, LLC

(57) ABSTRACT

A diaphragm structured for use in a diaphragm pump useful to pump a working fluid includes a first non-planar layer and a second non-planar layer. The second non-planar layer is independent from the first non-planar layer, but engaged to the first non-planar layer so that the first non-planar layer and the second non-planar layer form a closed space therebetween and travel together while flexing in an intake direction or a discharge direction within a pumping assembly of a diaphragm pump.

20 Claims, 10 Drawing Sheets

(56) References Cited

U.S. PATENT DOCUMENTS

| | | | | |
|---|---|---|---|---|
| 4,381,179 | A | 4/1983 | Pareja | |
| 4,963,075 | A | 10/1990 | Albertson et al. | |
| 4,971,523 | A * | 11/1990 | Wacker | F04B 43/009 417/63 |
| 5,074,757 | A * | 12/1991 | Horn | F04B 43/009 417/63 |
| 5,145,339 | A | 9/1992 | Lehrke et al. | |
| 5,707,217 | A * | 1/1998 | Loeffler | F04B 43/0736 417/339 |
| 5,894,784 | A * | 4/1999 | Bobbitt, III | F01B 19/02 92/100 |
| 6,017,199 | A * | 1/2000 | Yanaka | F02M 37/046 417/395 |
| 6,168,397 | B1 * | 1/2001 | Iwata | F04B 43/0072 417/477.12 |
| 6,343,539 | B1 * | 2/2002 | Du | F04B 43/0736 92/100 |
| 6,344,722 | B1 | 2/2002 | Abel | |
| 6,547,537 | B2 | 4/2003 | Olson | |
| 7,179,064 | B2 | 2/2007 | Folchert | |
| 7,467,582 | B2 | 12/2008 | Hembree | |
| 8,192,173 | B2 | 6/2012 | Landrum | |
| 9,097,249 | B2 | 8/2015 | Petersen | |
| 9,611,840 | B2 | 4/2017 | Celotta | |
| 9,638,185 | B2 | 5/2017 | Hines | |
| 9,695,808 | B2 | 7/2017 | Glessbach | |
| 9,777,721 | B2 | 10/2017 | Hines | |
| 9,777,722 | B2 | 10/2017 | Hines | |
| 9,784,265 | B2 | 10/2017 | Hines | |
| 9,828,981 | B2 | 11/2017 | Krebs | |
| 10,072,650 | B2 | 9/2018 | Hines | |
| 10,161,393 | B2 | 12/2018 | Hines | |
| 2003/0039563 | A1 * | 2/2003 | Arbuckle | F04B 43/026 417/413.1 |
| 2003/0202892 | A1 | 10/2003 | Orfi | |
| 2007/0092385 | A1 * | 4/2007 | Petrie Pe | F04B 53/22 417/395 |
| 2012/0098215 | A1 * | 4/2012 | Rositch | B60G 17/0408 280/6.157 |
| 2017/0328357 | A1 | 11/2017 | Ruppert | |
| 2017/0328359 | A1 | 11/2017 | Ottosen | |
| 2018/0017045 | A1 | 1/2018 | Rosenkranz | |
| 2018/0073500 | A1 | 3/2018 | Krebs | |
| 2018/0080442 | A1 | 3/2018 | Davis | |
| 2018/0230979 | A1 | 8/2018 | Turner | |
| 2018/0306170 | A1 | 10/2018 | Ottosen | |
| 2018/0372083 | A1 | 12/2018 | Hembree | |
| 2019/0136844 | A1 | 5/2019 | Ezzo et al. | |

FOREIGN PATENT DOCUMENTS

| | | | | |
|---|---|---|---|---|
| DE | WO 2004007960 | A1 * | 1/2004 | F04B 43/0054 |
| EP | 2458210 | A1 | 5/2012 | |
| FR | 2934332 | A1 * | 1/2010 | F04B 43/009 |
| GB | 305235 | A * | 5/1930 | F04B 9/06 |
| GB | 1234921 | A | 6/1971 | |

OTHER PUBLICATIONS

Machine Translation of WO 2004007960 A1 to Schuetze retrieved from espaceneton Dec. 6, 2022 (Year: 2022).*

Ingersoll Rand—ARO, Operator's Manual PX15X-XXX-XXX-AXXX, 1-1/2 Diaphragm Pump, Aug. 7, 2003, 12 pages.

Milton Roy LLC, Primeroyal Series Metering Pumps Brochure, 2018, 8 pages.

Graco Inc., Husky 2150e Electric-Operated Diaphragm Pump 3A5131A, 2017, 42 pages.

Extended European Search Report for Application No. 22152563.7 dated Jul. 20, 2022, 9 pages.

* cited by examiner

DIAPHRAGM PUMP

TECHNICAL FIELD

The present disclosure generally relates to diaphragm pumps, and more particularly, but not exclusively, to diaphragm constructions useful with a diaphragm pump.

BACKGROUND

Providing diaphragms with suitable and long lasting diaphragms remains an area of interest. Some existing systems have various shortcomings relative to certain applications. Accordingly, there remains a need for further contributions in this area of technology.

SUMMARY

One embodiment of the present disclosure is a unique diaphragm construction used within a diaphragm pump. Other embodiments include apparatuses, systems, devices, hardware, methods, and combinations for constructing diaphragms of diaphragm pumps.

For example, in one example embodiment, a diaphragm structured for use in a diaphragm pump useful to pump a working fluid is presented herein. The diaphragm, which is also referred to herein as a split-layer diaphragm, includes a first non-planar layer and a second non-planar layer. The second non-planar layer is independent from the first non-planar layer, but engaged to the first non-planar layer so that the first non-planar layer and the second non-planar layer form a closed space therebetween and travel together while flexing in an intake direction or a discharge direction within a pumping assembly of a diaphragm pump.

At least because the diaphragm is formed from multiple layers that form closed spaces therebetween (referred to herein as inter-layer closed spaces or volumes), the diaphragm may be a high strength, long lasting diaphragm. Specifically, the multiple layers may avoid parasitic sheer while collectively forming a high-strength membrane that may, for example, endure high pressure differentials created by mechanical actuations of the diaphragm. Moreover, since the diaphragm is formed from non-planar diaphragm layers, the diaphragm may be suitable for longer-stroke diaphragm pumps that typically operate at lower pressures (e.g., under 500 pounds per square inch (psi)), as opposed to shorter-stroke diaphragm pumps that typically operate at higher pressures (e.g., upwards of 1,000 psi). In fact, in some embodiments, the diaphragm is non-planar because it includes an inwardly cupping, annular convolute that renders the diaphragm suitable for mechanical actuations.

In some embodiments, the first layer and second layer of the diaphragm engage via at least one sealing feature to ensure the layers form a closed space therebetween and travel together. As an example, the diaphragm may include a first mating element disposed on a radially exterior section of at least one face of opposing faces of the first non-planar layer and the second non-planar layer. Additionally or alternatively, the diaphragm may include a second mating element disposed on a radially interior section of at least one face of the opposing faces of the first non-planar layer and the second non-planar layer. Sealing features on the exterior section and interior section may ensure the layers remain engaged adjacent both a central interface and an outer rim. In some instances, the first and second mating elements comprise beads provided on one layer that compress into the other layer.

Moreover, in some embodiments, the first non-planar layer and the second non-planar layer comprise two non-planar layers of equal thickness formed from a thermoplastic elastomer material. For example, the two non-planar layers may be formed from a thermoplastic vulcanizate, such as Santoprene, which is available from Exxon Mobil Corporation. Alternatively, at least one of the two non-planar layers may be a composite construction including a reinforcement and a matrix material. The reinforcement may be a fabric, a pseudo-fabric, or both.

In at least some embodiments with two non-planar layers of equal thickness, the diaphragm also includes a third non-planar layer disposed exteriorly of the first non-planar layer and the second non-planar layer. The third non-planar layer may be structured to be in contact with a working fluid being pumped through the diaphragm pump. That is, the third non-planar layer may be a fluid compatibility layer configured to protect the first and second layers from a working fluid, for example, if the working fluid is acidic, basic, and/or includes contaminates. For example, the third non-planar layer may be formed from polytetrafluoroethylene, thermoplastic, a thermoplastic vulcanizate, or a thermoplastic polyester elastomer, depending on a composition of the working fluid.

Still further, in some embodiments, the first non-planar layer is structured to be in contact with the working fluid in the pumping chamber during operation of the diaphragm pump and the second non-planar layer is structured to carry a load associated with a differential pressure formed across the split-layer diaphragm during operation of the diaphragm pump that is higher than a load carried by the first non-planar layer. For example, the second non-planar layer may have a higher stiffness than the first layer that allows the second non-planar layer to carry a higher load. In at least some of these embodiments, the first non-planar layer is formed from a polytetrafluoroethylene, thermoplastic, a thermoplastic vulcanizate, or a thermoplastic polyester elastomer, depending on the composition of the working fluid.

According to another example embodiment, a diaphragm pump is presented herein. The diaphragm pump includes an inlet structured to receive a fluid, an outlet structured to convey a fluid discharged by the diaphragm pump, a pumping assembly disposed between the inlet and the outlet, and a split-layer diaphragm disposed within the pumping assembly. The split-layer diaphragm is comprised of two or more unbonded, non-planar diaphragm layers that travel together, with adjacent layers of the two or more unbonded, non-planar diaphragm layers forming a closed space therebetween. The split-layer diaphragm is configured to flex in an intake direction to draw a working fluid into a pumping chamber defined by the split-layer diaphragm within the pumping assembly, and to flex in a discharge direction to expel the working fluid from the pumping chamber.

In various embodiments, the split-layer diaphragm may include any features, components, or structures described in connection with the diaphragm discussed above and, thus, may realize the same advantages. Additionally or alternatively, the diaphragm pump may include a mechanical actuator configured to extend through a central interface of the split-layer diaphragm and to flex the split-layer diaphragm in both the intake direction and the discharge direction. Thus, the diaphragm pump may realize the advantages of the split-layer diaphragm in a mechanically actuated diaphragm pump, which may generate harsher operating conditions than comparable air or hydraulically actuated diaphragm pumps.

Moreover, in some embodiments, the diaphragm pump may include a fluid washer and a back washer, and a washer pad. In such embodiments, the split-layer diaphragm is sandwiched between the washers and the washer pad is disposed between the split-layer diaphragm and the back washer. The washer pad is structured to resist wear caused by relative movement of a back layer of the split-layer diaphragm and an actuator acting on the split-layer diaphragm. For example, the washer pad may be softer (e.g., have a lower durometer rating) than the back layer of the split-layer diaphragm so that wear is pushed from the split-layer diaphragm to the back washer. This may extend the lifespan of the split-layer diaphragm. In at least some of these embodiments, the washer pad is formed from a thermoplastic vulcanizate, an ultra-high molecular weight polyethylene, or a combination thereof.

Still further, in some embodiments, the split-layer diaphragm is a first split-layer diaphragm, the pumping assembly is a first pumping assembly and the diaphragm pump also includes a second split-layer diaphragm disposed with a second pumping assembly and a third split-layer diaphragm disposed with a third pumping assembly. Three pumping assemblies may lower the pressure experienced by each split-layer diaphragm, thereby reducing the stress experienced by each split-layer diaphragm and allowing an overall size (e.g., diameter) of the split-layer diaphragms to be reduced. Additionally, decreasing the pressure experienced by each split-layer diaphragm may reduce or eliminate pressure ripples downstream of the diaphragm pump.

Further embodiments, forms, features, aspects, benefits, and advantages of the present application shall become apparent from the description and figures provided herewith.

BRIEF DESCRIPTION OF THE FIGURES

To complete the description and in order to provide for a better understanding of the present invention, a set of drawings is provided. The drawings form an integral part of the description and illustrate an embodiment of the present invention, which should not be interpreted as restricting the scope of the invention, but just as an example of how the invention can be carried out. The drawings comprise the following figures.

DETAILED DESCRIPTION

Figure 1:
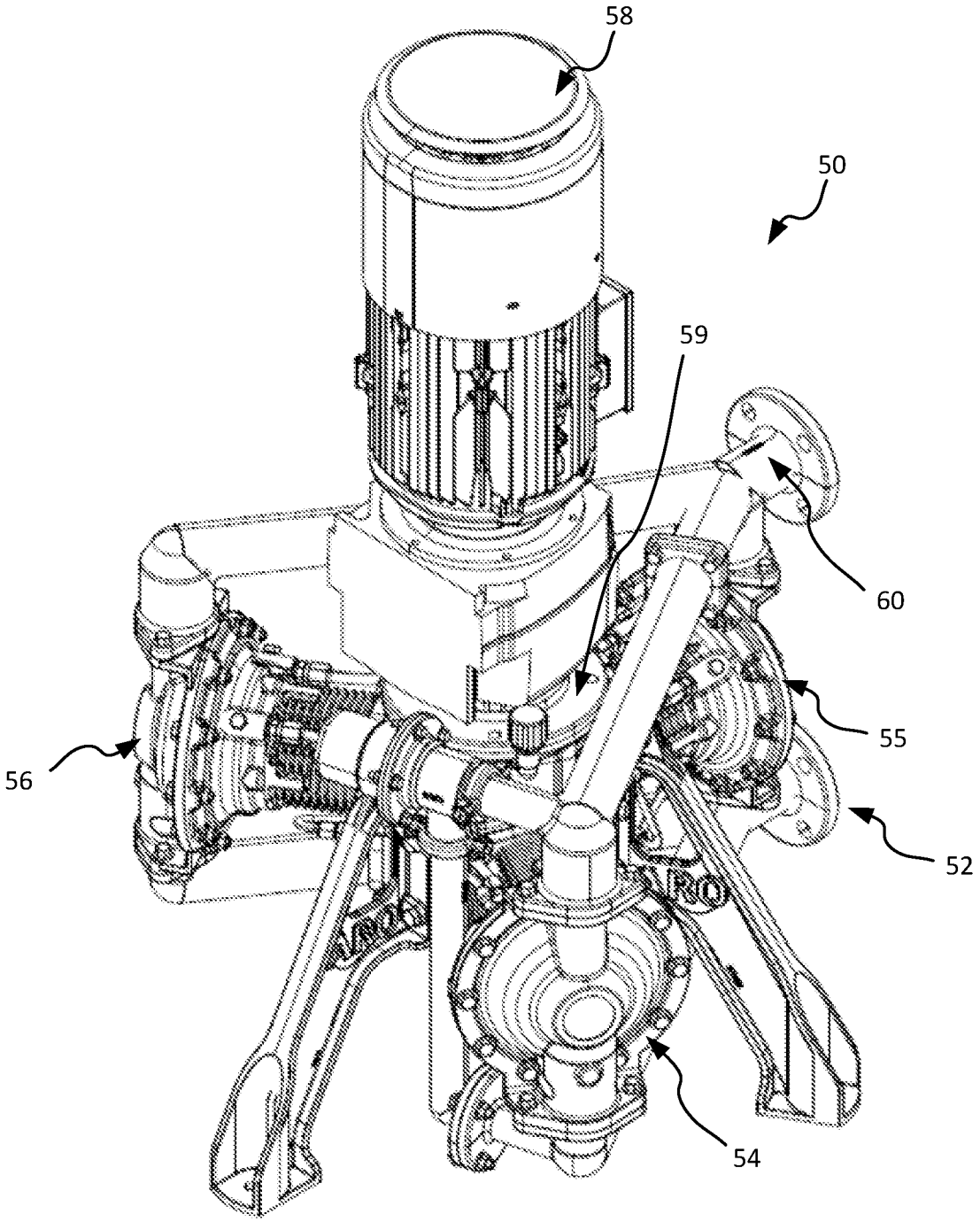
FIG. 1 depicts a perspective view of a diaphragm pump in which the diaphragm construction presented herein may be included, according to a first example embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Generally, a split-layer diaphragm and a diaphragm pump including the same are presented herein. The split-layer diaphragm includes two or more non-planar, unbonded diaphragm layers. That is, the split-layer diaphragm includes two or more undulating, independent layers. Since the diaphragm layers are unbonded, the diaphragm layers define separate sliding boundaries, which reduce stress on the diaphragm layers. Put another way, since the diaphragm layers are unbonded, the split-layer diaphragm may eliminate parasitic sheer between layers. However, at the same time, the diaphragm layers do not separate and travel together.

In some embodiments, the diaphragm layers travel together because closed spaces are formed between adjacent layers (also referred to as inter-layer closed spaces or volumes). Additionally or alternatively, the diaphragm layers may include sealing features, such as pressure ridges and/or interlocking beads that allow the diaphragm layers to mate and travel together. In fact, in at least some embodiments, the sealing features allow each layer to engage adjacent layers in a manner that creates inter-layer closed spaces. The sealing features may also engage portions of a pump assembly, such as washers and glands, to secure and seal the split-layer diaphragm within a pumping cavity of the pumping assembly.

In at least some embodiments, the diaphragm construction presented herein (i.e., a split-layer diaphragm) may be particularly advantageous for mechanically actuated pumps, which often require a high-strength diaphragm to withstand the pressure differentials created across the diaphragm. Typically, the pressure differentials created by a mechanically actuated diaphragm pump are much higher than pressure differentials created by air or hydraulically actuated diaphragm pumps. This is because air or hydraulically actuated diaphragm pumps maintain pressure in a non-worked fluid chamber, which balances the pressure differential across the diaphragm. By comparison, mechanically actuated diaphragms often do not generate a balancing pressure, leading to sinusoidal peaks of high pressure differentials. For example, when pumping working fluid at similar flow rates, a mechanically actuated diaphragm pump may generate a maximum pressure of 200 pounds per square inch (psi) peaks while an air or hydraulically actuated diaphragm pump may generate a maximum pressure of 120 psi.

Thus, although mechanically actuated diaphragm pumps often provide a simpler, more desirable pumping solution (e.g., due to cost of manufacturing and/or maintenance), mechanically actuated diaphragm pumps may require stronger diaphragms. The diaphragm construction presented herein may provide increased strength as compared to conventional diaphragms at least because the unbonded layers allow the diaphragm to have an increased overall thickness, at least as compared to a single layer or bonded layer construction that would fail with a similar overall thicknesses. Moreover, the diaphragm construction presented herein may provide this increased strength without experiencing delamination issues that are often encountered by diaphragms that are reinforced with a fabric, which is added in an attempt to increase the strength of the diaphragm.

In embodiments that are particularly advantageous for mechanically actuated pumps, the split-layer diaphragm can include an annular, inwardly cupping convolute (which may render the split-layer diaphragm non-planar). That is, in embodiments that are particularly advantageous for mechanically actuated pumps, the split-layer diaphragm includes an annular convolute that curves away from a pumping chamber for working fluid, which may have a higher pressure than an actuating or non-worked fluid chamber housing a mechanical actuator. By comparison, diaphragms for air or hydraulically diaphragm pumps may include convolutes that cup outwards, away from an actuating chamber that can be pressurized to cause a diaphragm to flex in a discharge direction.

Now turning to FIG. 1, this Figure illustrates a perspective view of a diaphragm pump 50 in which the diaphragm construction presented herein may be installed, according to an example embodiment. Diaphragm pump 50 is a mechanically actuated, triple diaphragm pump. However, diaphragm pump 50 is merely an example embodiment and, in other embodiments, a single diaphragm pump, double diaphragm pump, or a diaphragm pump including any number of diaphragms may employ the diaphragm construction presented herein. Additionally or alternatively, the diaphragm construction presented herein may be air operated, electrically operated, or driven in any other manner now known or developed hereafter. That is, a skilled artisan, upon reading the present disclosure, will appreciate that the mechanically actuated, triple diaphragm pump shown in FIG. 1 is depicted for illustrative purposes.

That said, the diaphragm pump 50 depicted in FIG. 1 includes an inlet manifold 52 configured to deliver a working fluid to a first pump assembly 54, a second pump assembly 55, and a third pump assembly 56. Pumping assemblies 54, 55, and 56 each house a split-layer diaphragm 100 (see, e.g., FIG. 3) that is operatively coupled to a drive mechanism 58 via a main body 59 of the diaphragm pump 50. For example, the drive mechanism 58 may include an electric motor and the main body 59 may house one or more slider-crank mechanisms that convert rotational motion of the motor into linear motion that can drive movement (e.g., cause inward and outward flexing) of the split-layer diaphragms 100 within pumping assemblies 54, 55, and 56. Movement of the split-layer diaphragms 100 moves (i.e., pumps) working fluid from inlet manifold 52 to an outlet manifold 60.

Although the triple diaphragm pump 50 is merely an example, such an arrangement may also distribute pressure among three pumping assemblies 54, 55, and 56, which may allow the pumping assemblies 54, 55, and 56 to utilize split-layer diaphragms 100 with smaller diameters. That is, distributing pressure among three pumping assemblies 54, 55, and 56 may reduce the stress and/or duty cycle applied to each split-layer diaphragm 100, which may allow the diaphragm pump 50 to utilize smaller split-layer diaphragms 100 than, for example, dual or single diaphragm pumps structured to operate at similar operating parameters and/or under similar operating conditions. Distributing the pressure to three pumping assemblies 54, 55, and 56 may also reduce downstream pressure ripples (e.g., downstream of outlet manifold 60).

Figure 2:
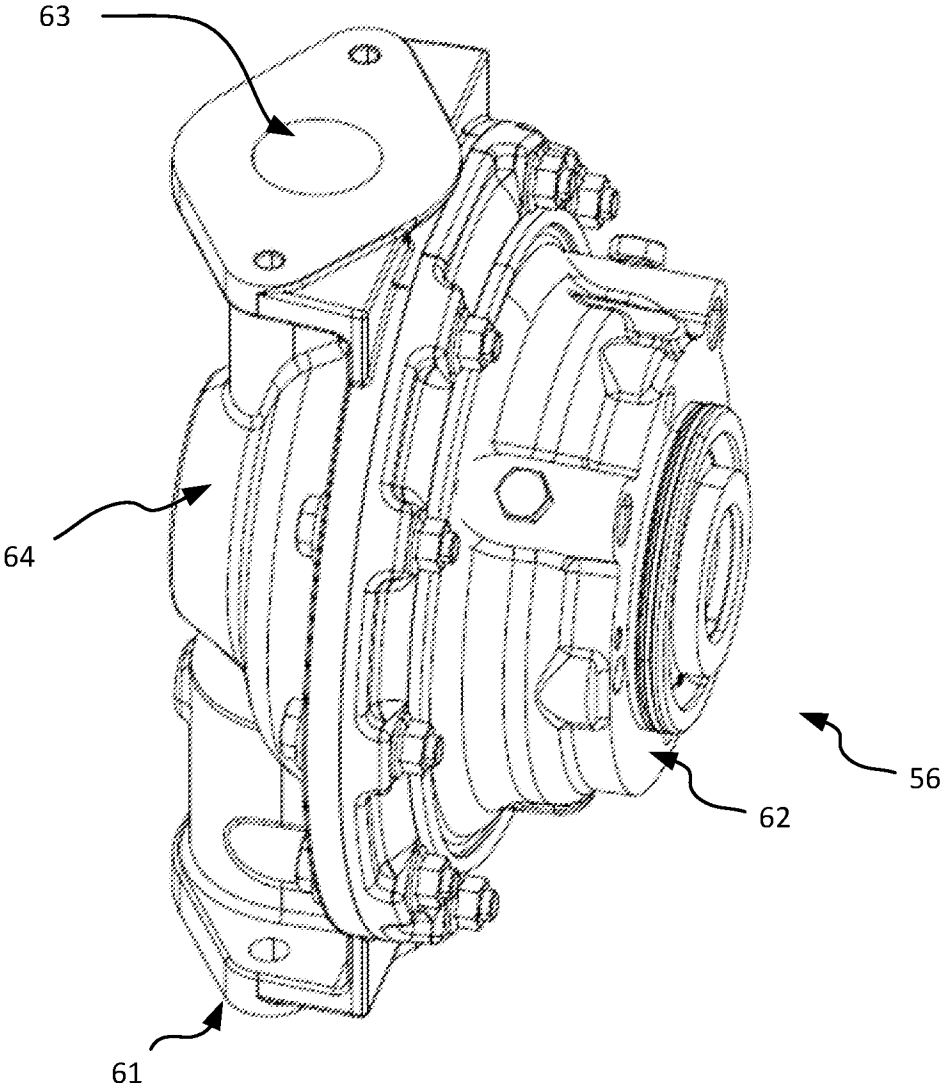
FIG. 2 depicts a perspective view of a pumping assembly included in the diaphragm pump of FIG. 1, according to an example embodiment.
Figure 3:
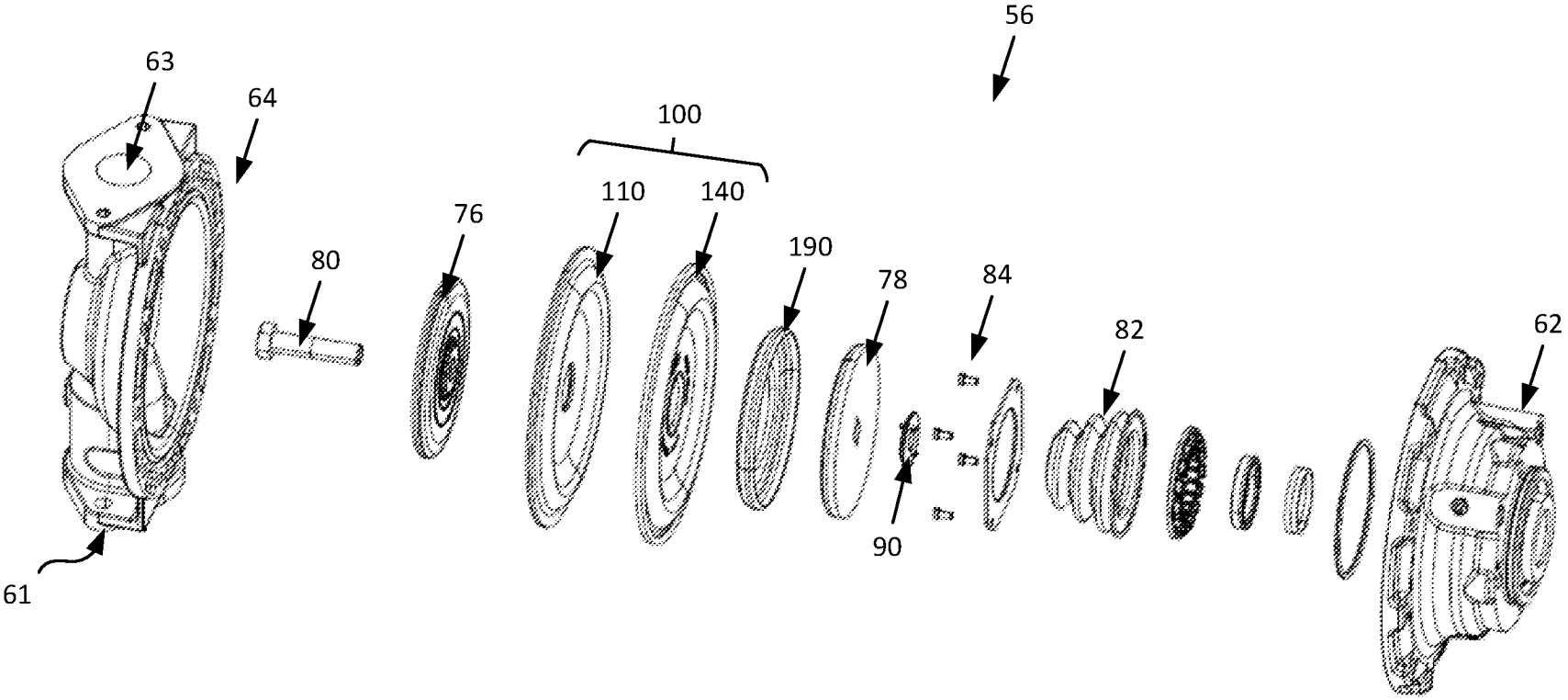
FIG. 3 depicts an exploded view of the pumping assembly of FIG. 2.
Figures 4, 5, 6, 7:
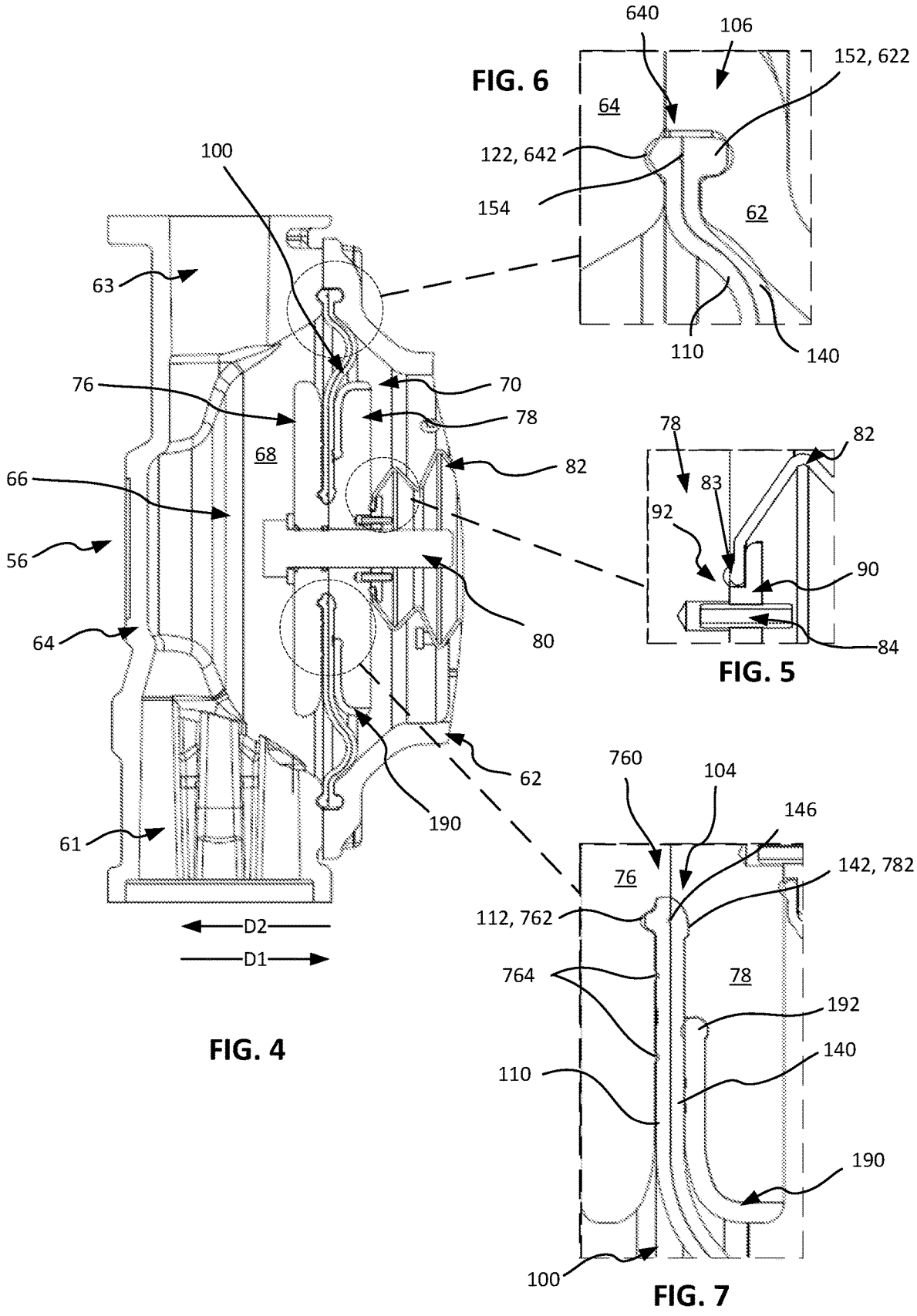
FIG. 4 depicts a side sectional view of the pumping assembly of FIG. 2.
FIGS. 5-7 depict enlarged views of portions of the sectional view of FIG. 4.

FIGS. 2-4 depict a perspective view, an exploded view, and a sectional view of the third pumping assembly 56, respectively, but these views are also representative of the first pump assembly 54 and the second pump assembly 55. As can be seen, the third pump assembly 56 includes a pumping cavity inlet 61 and a pumping cavity outlet 63 that guide a working fluid into and out of the third pump assembly 56, respectively (from inlet manifold 52 and towards outlet manifold 60, respectively). In the depicted embodiment, the pumping cavity inlet 61 and the pumping cavity outlet 63 are defined by a pump head 64. Meanwhile, a base 62 and the pump head 64 define a pumping cavity 66 between the pumping cavity inlet 61 and the pumping cavity outlet 63.

As can be seen in FIG. 4, the split-layer diaphragm 100 divides (e.g., splits) the pumping cavity 66 into a pumped fluid-side portion 68 (also referred to as a pumping chamber 68 or working fluid chamber 68) and non-pumped fluid-side portion 70 (also referred to as non-worked fluid chamber 70). The split-layer diaphragm 100 is described in further detail below, but, generally, the split-layer diaphragm 100 includes at least a first layer 110 and a second layer 140. When the split-layer diaphragm 100 flexes inwards, in intake direction D1 (e.g., towards base 62), the split-layer diaphragm 100 draws a working fluid into the pumping chamber 68 from pumping cavity inlet 61 (via inlet manifold 52). Alternatively, when the split-layer diaphragm 100 flexes outwards, in discharge direction D2 (e.g., towards pump head 64), the split-layer diaphragm 100 expels a working from the pumping chamber 68 via pumping cavity outlet 63 (towards outlet manifold 60).

In the depicted embodiment, the split-layer diaphragm 100 is secured within the pumping cavity 66 by a fluid washer 76 and a backside washer 78 that are configured to flex the split-layer diaphragm 100 in the intake direction D1 or the discharge direction D2. More specifically, in the depicted embodiment, fluid washer 76 and backside washer 78 sandwich the split-layer diaphragm 100. Then, a bolt 80 extends through the fluid washer 76, the backside washer 78, and the split-layer diaphragm 100 to couple washers 76, 78 and the split-layer diaphragm 100 to an actuation device, such as a rod, piston, slider-crank, or the like, (e.g., within main body 59) that is driven by drive mechanism 58 (e.g., an electric motor).

For example, in the depicted embodiment, the bolt 80 may be secured to a piston (not shown) and tightly couple washers 76 and 78 against the piston. To achieve this, an enlarged head of the bolt 80 engages an outer surface of the fluid washer 76 and the backside washer 78 is secured on the bolt 80, between the fluid washer 76 and the piston. Thus, the fluid washer 76, the backside washer 78, and the bolt 80 may all be secured, either directly or indirectly, to a piston and will move in response to movements of the piston.

Additionally, a bellows 82 extends from the backside washer 78 to the base 62 to encapsulate and protect the bolt 80 and piston (or other actuator). However, in the depicted embodiment, the bellows 82 is not reliant on only its own resiliency to maintain engagement with the backside washer 78. Instead, coupler 90 is structured to ensure that the bellows 82 remains sealed to the backside washer 78. Additionally, coupler 90 may be structured to distribute stress from the backside washer 78 to a piston, thereby protecting the backside washer 78 from exposure to high contact stress.

For example, as is shown in the enlarged view of FIG. 5, the coupler 90 may include an undercut portion 92 configured to receive a protrusion 83 included on a distal end of the bellows 82. The protrusion 83 extends outwards (e.g., in the discharge direction D2), towards the backside washer 78 and, thus, can seal against the backside washer 78. In fact, at least because the coupler 90 can be directly coupled to a piston disposed within the bellows 82, outward movement of the piston may act to maintain a seal between the bellows 82 and the backside washer 78. Consequently, even if the backside washer 78 experiences stress that causes bending, which often occurs during operation of a diaphragm pump, contact stresses through the protrusion 83 may be sufficient to maintain a seal against the backside washer 78 and protect an actuator disposed within the bellows 82.

Additionally, since the undercut portion 92 of the coupler 90 allows a portion of the coupler to contact with the backside washer 78, the coupler 90 may distribute stress from the backside washer 78 to a piston while sealing the bellows 82 against the backside washer 78. In the depicted embodiment, roll pins 84 also extend through the coupler 90 into the backside washer 78. Roll pins 84 ensure that the coupler 90 and bellows 82 do not twist when the bolt 80 is torqued, which could lead to early failure.

However, washer 76, washer 78, and bolt 80, as well as other components associated therewith, are merely an example actuation arrangement and other embodiments might utilize variations thereof or entirely different actuation arrangements. For example, in some embodiments, bolt 80 might extend through only a portion (e.g., one or more layers) of the split-layer diaphragm 100. Alternatively, a fastener might extend through one or more layers of the split-layer diaphragm 100 and attach to a rod disposed adjacent base 62. As another example, in some embodiments, motive fluid, such as air or hydraulic fluid, may be disposed in the non-worked fluid chamber 70 to move or assist in moving the split-layer diaphragm 100 to draw in and push out (i.e., expel) a working fluid from pumping chamber 68. Still further, in some embodiments, bolt 80 may be coupled to the drive mechanism 58 (e.g., an electric motor) via a linkage and/or may be coupled to another diaphragm (e.g., in a dual diaphragm pump).

Now referring to 6-9, in the depicted embodiment, the split-layer diaphragm 100 is an annular component that extends around a central opening 101 (also referred to as interface 101). As can be seen in at least FIG. 8, the split-layer diaphragm 100 extends from an inner section 104 to an exterior section 106. The inner section 104 is proximate to and/or defines the central opening 101 and the exterior section 106 is proximate to and/or forms an outer rim 107 of the split-layer diaphragm 100.

As mentioned above, in the depicted embodiment, the split-layer diaphragm 100 is formed from a first layer 110 and a second layer 140. However, these two layers are merely one example construction and, in other embodiments, the split-layer diaphragm 100 may be formed from two or more layers. Generally, the two or more layers of the split-layer diaphragm 100 have substantially the same cross-sectional dimensions (e.g., the same diameter and a central opening 101 of the same size) and are structured so that adjacent layers form a closed space therebetween. Thus, the layers travel together when the split-layer diaphragm 100 is secured within a pumping cavity 66, such as by washers 76 and 78 sandwiching the split-layer diaphragm 100 and/or by pressure acting on one or more external layers of the split-layer diaphragm 100.

That is, if the split-layer diaphragm 100 includes n layers, the split-layer diaphragm 100 may form n−1 closed spaces between the n layers, with one closed space formed between each pair of adjacent layers. Thus, as mentioned, the closed spaces(s) may be referred to herein as inter-layer closed space(s). The inter-layer closed space(s) may ensure that the layers of the split-layer diaphragm 100 travel together when the split-layer diaphragm 100 flexes in a intake direction D1 or a discharge direction D2 (e.g., during an outward and inward stroke of a piston).

This is because the inter-layer closed spaces define a fixed volume between the layers that minimizes pressure between the layers. In some embodiments, the amount of fluid enclosed in this fixed volume may be minimized to ensure the pressure between the layers is minimized. In fact, in some instances, fluid can be removed from the closed area to form a vacuum in an inter-layer closed space. Additionally or alternatively, the volume of each enclosed space may be maximized.

In at least some embodiments, the inter-layer closed spaces are unlubricated closed spaces. That is, the inter-layer closed spaces may not be formed around a quantity of lubricant. However, in other embodiments, a quantity of lubricant may be included in the closed space.

Moreover, the split-layer diaphragm 100 presented herein is a non-planar diaphragm. That is, the split-layer diaphragm 100 has undulations or curvature and is not a flat disk. In the depicted embodiment, the split-layer diaphragm 100 is non-planar at least because first layer 110 and second layer 140 include annular convolutes 120 and 150, respectively (see FIG. 9), that mesh or mate to form an annular convolute 102 for the split-layer diaphragm 100. The convolute 102 is an annular, inwardly cupping convolute 102 and, thus, curves or bends into the non-worked fluid chamber 70, towards the base 62 (and towards an actuator included in non-worked fluid chamber 70). As mentioned above, an inwardly cupping convolute 102 may render the split-layer diaphragm 100 particular suitable for mechanical actuations, since the convolute 102 will cup away from the pumping chamber 68 and the higher pressures than may be generated therein.

Still referring to FIG. 6-9, but now with a focus on FIGS. 6 and 7, the diaphragm construction presented herein may, in at least some embodiments, include one or more sealing features that assist with forming the inter-layer closed space(s) between adjacent layers of the split-layer diaphragm 100. That is, the one or more sealing features of the split-layer diaphragm 100 may ensure that inter-layer closed space(s) are maintained throughout operation of a diaphragm pump in which the split-layer diaphragm 100 is included. Put still another way, the sealing features of the split-layer diaphragm 100 (e.g., beads) may provide pressure and flow containment for each inter-layer closed space. Additionally, the one or more sealing features may seal the working fluid chamber 68 with respect to the non-worked fluid chamber 70.

In the depicted embodiment, sealing features are included on an inner section 104 and an exterior section 106 of the split-layer diaphragm 100. That is, in the depicted embodiment, the inner section 104 of the split-layer diaphragm 100 includes one or more sealing elements disposed proximate the central opening 101 while the exterior section 106 of the split-layer diaphragm 100 includes one or more sealing elements disposed at or proximate the outer rim 107. The sealing features seal the first layer 110 against the second layer 140 and may also seal the split-layer diaphragm 100 against components of the pumping assembly 56, such as the fluid washer 76, the backside washer 78, the base 62, and/or the pump head 64. In particular, the sealing features may be configured to seal the split-layer diaphragm 100 and the working fluid chamber 68 while allowing metal-to-metal joints to be formed between the base 62 and the pump head 64 and between the actuator (e.g., a piston) and the bolt 80.

More specifically, the sealing features on the exterior section 106 may seal the first layer 110 to the second layer 140 and may also seal the exterior section 106 against the base 62 and the pump head 64, but without preventing a metal-to-metal joint between the base 62 and the pump head 64. Meanwhile, the sealing features on the inner section 104 may seal the first layer 110 to the second layer 140 and may also seal the inner section 104 against the fluid washer 76 and the backside washer 78, but without preventing a metal-to-metal joint (i.e., bolted joint) between washer 76, washer 78, and bolt 80. Thus, collectively, the sealing features on the inner section 104 and the exterior section 106 may form a closed space (of maximum volume) between the central opening 101 and the outer rim 107 while also forming seals between the working fluid chamber 68 and the non-worked fluid chamber 70. The sealing features included on the exterior section 106 and the sealing features included on the inner section 104 are each described in further detail below in connection with FIGS. 6 and 7.

First, as can be seen in FIG. 6, in the depicted embodiment, the exterior section 106 includes sealing features in the form of an exterior cap 122 formed on the first layer 110, an exterior cap 152 formed on the second layer 140, and a mating element 154 formed on the second layer 140. The exterior caps 122, 152 define the overall shape of the exterior section 106 and are configured to sit within and seal against an exterior gland 640. The exterior gland 640 is formed by a front gland geometry 642 defined by the pump head 64 and a back gland geometry 622 defined by the base 62. The exterior cap 122 of the first layer 110 may mate with and/or engage the front gland geometry 642 while the exterior cap 152 of the second layer 140 may mate with and/or engage the back gland geometry 622.

More specifically, in the depicted embodiment, the working fluid chamber 68 is sealed off from the non-worked fluid chamber 70 because: (1) the exterior cap 122 of the first layer 110 engages the front gland geometry 642; and/or (2) the exterior cap 152 of the second layer 140 engages the back gland geometry 622. For example, in the depicted embodiment, the exterior cap 122 has a rounded front end that can press against an into a V-shaped front gland geometry 642 to form a seal therebetween. On the other end, the back end of the exterior cap 152 may be rounded while the back gland geometry 622 has a square shape. Thus, engaging exterior cap 152 with back gland geometry 622 may create two acute points of contact between the exterior cap 152 and the back gland geometry 622 that seal the exterior gland 640 from the non-worked fluid chamber 70.

Notably, in the depicted embodiment, the front gland geometry 642 is coupled to the back gland geometry 622 via a metal-to-metal joint. That is, the exterior section 106 of the split-layer diaphragm 100 is secured within the exterior gland 640, but does not extend out of the exterior gland 640, for example, to be secured between the pump head 64 and the base 62. This avoids stressing the exterior section 106 of the split-layer diaphragm 100 while also eliminating leakage issues that may be encountered when a diaphragm material secured between the pump head 64 and base 62 creeps.

Still referring to FIG. 6, in the depicted embodiment, the second layer 140 includes a mating element 154 configured to engage the first layer 110. In at least some embodiments, mating element 154 comprises a bead that will press into a soft or pliable material used to form the first layer 110 (examples of which are described in detail below) when the first layer 110 is compressed against the second layer 140 (e.g., by washers 76 and 78). Additionally, since the exterior cap 122 has a rounded front end that can press against an into a V-shaped front gland geometry 642, the exterior cap 122 may prevent rotation of the first layer 110 on the mating element 154. Meanwhile, the shapes of the exterior cap 152 of the second layer 140 and the back gland geometry 622 may allow room for the mating element 154 to compress into the first layer 110.

That said, in other embodiments, a mating element 154 included at the exterior section 106 of the split-layer diaphragm 100 need not be included on the second layer 140 and could be included on a rear face of the first layer 110. Alternatively, the mating element 154 may comprise mating elements on both opposing faces of the first layer 110 and the second layer 140. For example, first layer 110 might include a bead and second layer 140 might include a corresponding groove. Additionally or alternatively, in some embodiments, the mating element 154 may be included outside of, but proximate to the exterior gland 640. For example, if the split-layer diaphragm 100 includes three or more layers, a first pair of opposing faces might be engaged via a mating element 154 disposed in the exterior gland 640 while a second pair of opposing faces are engaged via a mating element 154 disposed outside (e.g., interiorly of) the exterior gland 640. As another example, one set of opposing faces of layers in the split-layer diaphragm 100 might be engaged by two or more mating elements 154 positioned within and/or outside of the exterior gland 640.

Second, and now turning to FIG. 7, the inner section 104 includes sealing features in the form of an interior cap 112 formed on the first layer 110, an interior cap 142 formed on the second layer 140, and a mating element 146 formed on the second layer 140. The interior caps 112, 142 define the overall shape of the inner section 104 and are configured to sit within and seal against an interior gland 760. The interior gland 760 is formed by a front gland geometry 762 defined by the fluid washer 76 and a back gland geometry 782 defined by the backside washer 78. The interior cap 112 of the first layer 110 may mate with and/or engage the front gland geometry 762 while the interior cap 142 of the second layer 140 may mate with and/or engage the back gland geometry 782.

More specifically, in the depicted embodiment, the working fluid chamber 68 is sealed off from the non-worked fluid chamber 70 because: (1) the interior cap 112 of the first layer 110 engages the front gland geometry 762; and/or (2) the interior cap 142 of the second layer 140 engages the back gland geometry 782. For example, in the depicted embodiment, the interior cap 112 has a rounded front end that can press against an into a V-shaped front gland geometry 762 to form a seal therebetween. On the other end, the back end of the interior cap 142 may include a step configured to seat on a shoulder defined by the back gland geometry 782 defined by the backside washer 78.

Notably, in the depicted embodiment, the front gland geometry 762 is coupled to the back gland geometry 782 via a metal-to-metal joint. That is, the inner section 104 of the split-layer diaphragm 100 is secured within the interior gland 760, but does not extend out of the interior gland 760, for example, to be secured between the fluid washer 76 and the backside washer 78. This avoids stressing the inner section 104 of the split-layer diaphragm 100 while also eliminating leakage issues that might be encountered if a diaphragm material secured between the backside washer 78 and fluid washer 76 creeps.

Still referring to FIG. 7, in the depicted embodiment, the second layer 140 includes a mating element 146 configured to engage the first layer 110. In at least some embodiments, mating element 146 comprises a bead that will press into a soft or pliable material used to form the first layer 110 (examples of which are described in detail below) when the first layer 110 is compressed against the second layer 140 (e.g., by washers 76 and 78). Additionally, since the interior cap 112 has a rounded front end that can press against an into a V-shaped front gland geometry 762, the interior cap 112 may prevent rotation of the first layer 110 on the mating element 146. Meanwhile, the shapes of the interior cap 142 and the back gland geometry 782 may allow room for the mating element 146 to compress into the first layer 110.

That said, in other embodiments, a mating element 146 included at the inner section 104 of the split-layer diaphragm 100 need not be included on the second layer 140 and could be included on a rear face of the first layer 110. Alternatively, the mating element 146 may comprise mating elements on both opposing faces of the first layer 110 and the second layer 140. For example, first layer 110 might include a bead and second layer 140 might include a corresponding groove. Additionally or alternatively, in some embodiments, the mating element 146 may be included outside of, but proximate to the interior gland 760. For example, if the split-layer diaphragm 100 includes three or more layers, a first pair of opposing faces might be engaged via a mating element 146 disposed in the interior gland 760 while a second pair of opposing faces are engaged via a mating element 146 disposed outside (e.g., exteriorly of) the interior gland 760. As another example, one set of opposing faces of layers in the split-layer diaphragm 100 might be engaged by two or more mating elements 146 positioned within and/or outside of the interior gland 760.

Moreover, in some embodiments, the fluid washer 76 and/or the backside washer 78 also include sealing features that may engage the split-layer diaphragm 100, at or proximate to the inner section 104, to further secure the split-layer diaphragm 100 to the fluid washer 76 and the backside washer 78. For example, in the depicted embodiment, the fluid washer 76 includes mating elements 764 that act as sealing features and the backside washer 78 includes or is coupled to a washer pad 190 that is or includes sealing features.

In at least some embodiments, the mating elements 764 comprise pressure ridges and/or beads that will press into a soft or pliable material used to form the first layer 110 (examples of which are described in detail below). However, in other embodiments, mating elements 764 could be included on the first layer 110 and/or comprise a set of elements on the fluid washer 76 and the first layer 110 (e.g., a bead and corresponding groove).

The washer pad 190 comprises a layer of material that is softer (e.g., has a lower durometer rating) than a back layer of the split-layer diaphragm 100. For example, in the depicted embodiment, the washer pad 190 is softer than the second layer 140. Thus, the split-layer diaphragm 100 can push wear to the washer pad 190. Put another way, the washer pad 190 may be an abrasion layer configured to absorb abrasion created by movement of the split-layer diaphragm 100 so that the abrasion does not wear layers of the split-layer diaphragm 100. In fact, in at least embodiments, the washer pad 190 may be a sacrificial layer that is intended to wear while protecting the split-layer diaphragm 100.

As a specific example, if the split-layer diaphragm 100 is formed from two or more layers of a thermoplastic elastomer (TPE) in the form of a thermoplastic vulcanizate (TPV), such as Santoprene available from Exxon Mobil Corporation, the washer pad 190 may be formed from a TPV, such as Santorpene, with a lower durometer rating than the TPV used to form the layers of the split-layer diaphragm 100. Alternatively, the washer pad 190 may be formed from an ultra-high molecular weight polyethylene (UHMWPE), a TPE, or some combination of these materials, with or without TPV. To be clear, as used herein, the term "thermoplastic" can refer to a class of plastic that is melt processable such that it can be melted and reformed.

Additionally, in at least some embodiments, the washer pad 190 may include a protrusion 192 at its distal end. The protrusion 192 may be configured to compress and seal against the second layer 140. Thus, in the depicted embodiment, four sealing points may be formed at or adjacent to the inner section 104 of the split-layer diaphragm 100, between the split-layer diaphragm 100 and washers 76 and 78. Specifically, two of the sealing points are formed by mating elements 764, at least one sealing point is formed by interior caps 112 and 142, and another sealing point formed by protrusion 192. However, other embodiments may provide sufficient sealing with fewer sealing points. For example, other embodiment might provide sufficient sealing without washer pad 190 and could, for example, include a backside washer 78 with overall dimensions equal to the overall dimensions of the combination of the depicted backside washer 78 and washer pad 190.

Figure 8:
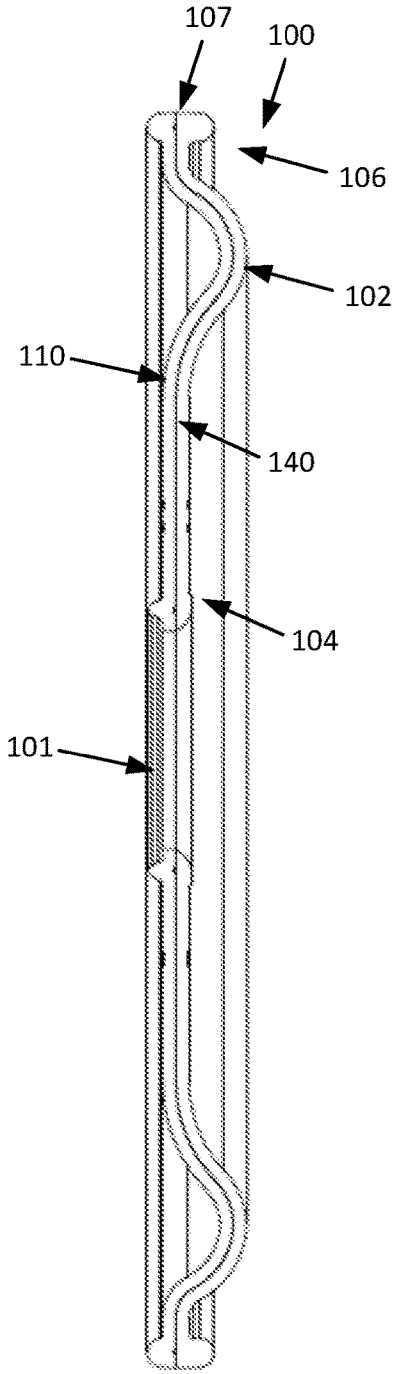
FIGS. 8 and 9 depict side views of a diaphragm included in the pumping assembly of FIG. 2, with layers of the diaphragm shown engaged in FIG. 7 and exploded in FIG. 8.
Figure 9:
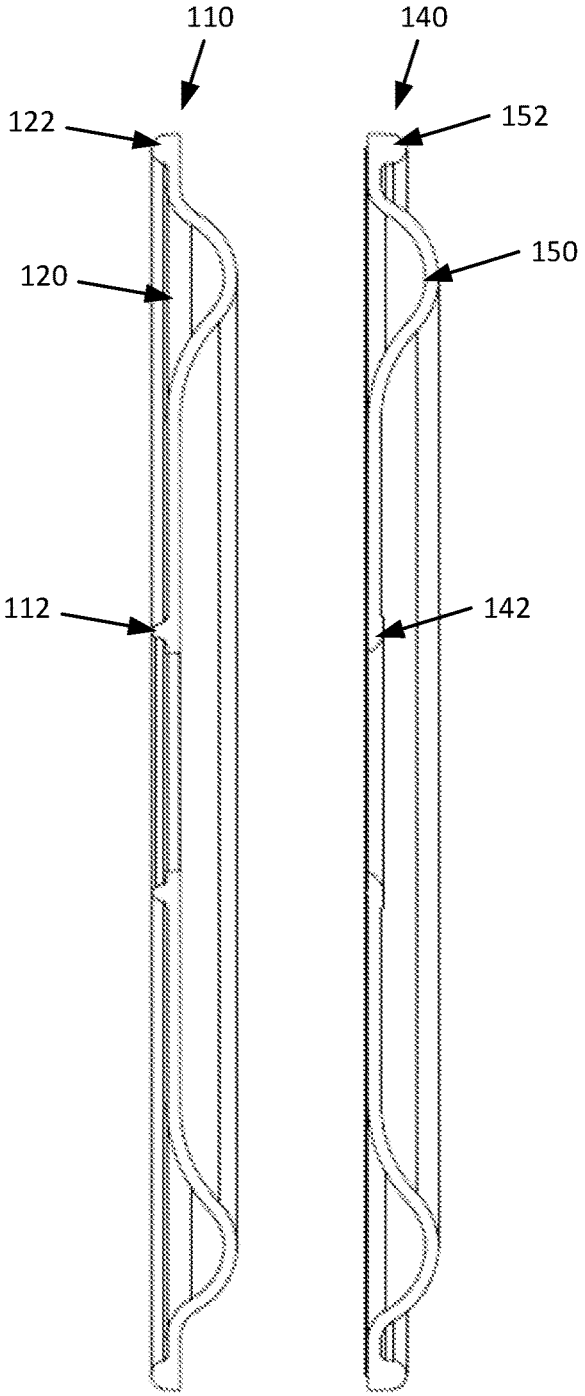

Now turning to FIGS. 8 and 9, in the depicted embodiment, first layer 110 and second layer 140 have substantially similar, if not identical geometries, and, thus are layers of equal thickness. For example, first layer 110 and second layer 140 may each have a thickness in the range of approximately 0.07 inches to approximately 0.10 inches, in the range of approximately 0.085 inches to approximately 0.095 inches, or even in the range of approximately 0.06 inches to approximately 0.11 inches, such as a thickness of approximately 0.090 inches. However, in other embodiments, first layer 110 and second layer 140 may have different thicknesses.

Moreover, in the depicted embodiment, the first layer 110 and the second layer 140 may be formed from the same material. Forming the first layer 110 and the second layer 140 from the same material may create a split-layer diaphragm 100 that has characteristics of a single layer of that material, but with improved flexibility, pliability, and/or stress management. For example, if first layer 110 and second layer 140 are both formed from a TPV, such as Santoprene, with a specific thickness (e.g., of 0.090 inches) and a specific durometer rating (e.g., 40D), the split-layer diaphragm 100 may have an overall membrane strength that is nearly equivalent to a single layer of Santoprene with a thickness that is double the thickness of each individual layer (e.g., 0.180 inches), but may experience less stress than this thicker layer of Santoprene. In fact, testing has found that forming the split-layer diaphragm 100 from two layers of Santoprene with a 40D durometer may extend the lifespan of a diaphragm to a lifespan that is five to twenty times longer that known diaphragms (i.e., a 500%-2000% increase in lifespan).

However, other materials, including other TPEs, such as Pebax available from Arkema S.A., may also provide an extended lifespan. In fact, the particular arrangement of the split-layer diaphragm 100 may allow the constituent layers to be formed from a variety of TPEs, including TPEs with durometer ratings that are not typically usable in mechanically actuated diaphragm pumps (e.g., since the harder durometer would not provide a combination of strength and flex to accommodate the stresses induced by differential pressure over a sufficient life span). As another example, in some instances, the layers of split-layer diaphragm 100 could be formed from a thermoplastic polyester elastomer such as Hytrel available from E.I. Du Pont De Nemours & Co.

Still further, in some embodiments, each layer may be a composite construction including a matrix material and a reinforcement material, such as a fabric, a pseudo-fabric, or both. That is, in some embodiments, the layers of split-layer diaphragm 100 (e.g., first layer 110 and second layer 140) are single material layers, but in other embodiments, multiple materials can form each constituent layer of the split-layer diaphragm 100. Example composite constructions are discussed in further detail below; however, generally, in at least some embodiments, multiple layers of material can be considered as a "layer" of the overall diaphragm construction (e.g., as first layer 110 or second layer 140). Thus, the term "layer" is not intended to limited to a single layer and/or a single monolithic layer; instead, the term "layer" is used herein for ease of convenience and is not intended to be limited to a single layer and/or single monolithic layer unless expressly stated to the contrary.

Moreover, the first layer 110 and the second layer 140 (as well as any other layers in the split-layer diaphragm 100) do not need to be formed from the same material. In fact, in some embodiments, the first layer 110 is formed from a first material and the second layer 140 is formed from a second material that is different from the first material. For example, the first layer 110 may be formed from a material suitable for handling fluid compatibility issues and the second layer 140 may be structured to support a higher load than the first layer 110 (with the load stemming from pressure differential across the split-layer diaphragm 100).

As a specific example, the first layer 110 may be formed from polytetrafluoroethylene (PTFE), a TPE, a TPV, such as Santoprene, or a thermoplastic polyester elastomer such as Hytrel, to provide a range of compatibility suitable for various working fluids, including highly acidic fluids, highly basic fluids, and fluids with particulate contamination (e.g., ceramic particulate). Any of these materials could be provided with a variety of thicknesses, such as a thickness in the range of approximately 0.02 inches to approximately 0.10 inches.

Meanwhile, the second layer 140 can be constructed with a strength and/or stiffness as well as flex life to accommodate more of the stresses induced by differential pressure across the split-layer diaphragm 100 than the first layer 110. In such instances, the second layer 140 can be made from a TPE, like Pebax, a TPV, like Santoprene, or a reinforced material, provided the composition allows the second layer 140 to accommodate stresses generated by high differential pressures across the diaphragm. In these embodiments, the second layer 140 may have a variety of thicknesses such as a thickness in the range of approximately 0.04 inches to approximately 0.10 inches.

Now turning to FIGS. 10-15, these Figures illustrate another example embodiment of a pumping assembly 56' that may be included in the diaphragm pump 50 of FIG. 1. In this example embodiment, the pumping assembly 56' is substantially similar to the third pumping assembly 56 described above, but now includes another example embodiment of a split-layer diaphragm 200. For example, the pumping assembly 56' includes the same base 62 and pump head 64 as pumping assembly 56. Thus, for brevity, the description of FIGS. 10-15 focuses on portions of pumping assembly 56' that differ from pumping assembly 56, such as split-layer diaphragm 200 and fluid washer 276. Otherwise, parts of pumping assembly 56' that are similar to (or identical to) parts of pumping assembly 56 are labeled with like numerals and any description of like numerals included herein should be understood to apply to like components or features of FIGS. 10-15.

Figure 10:
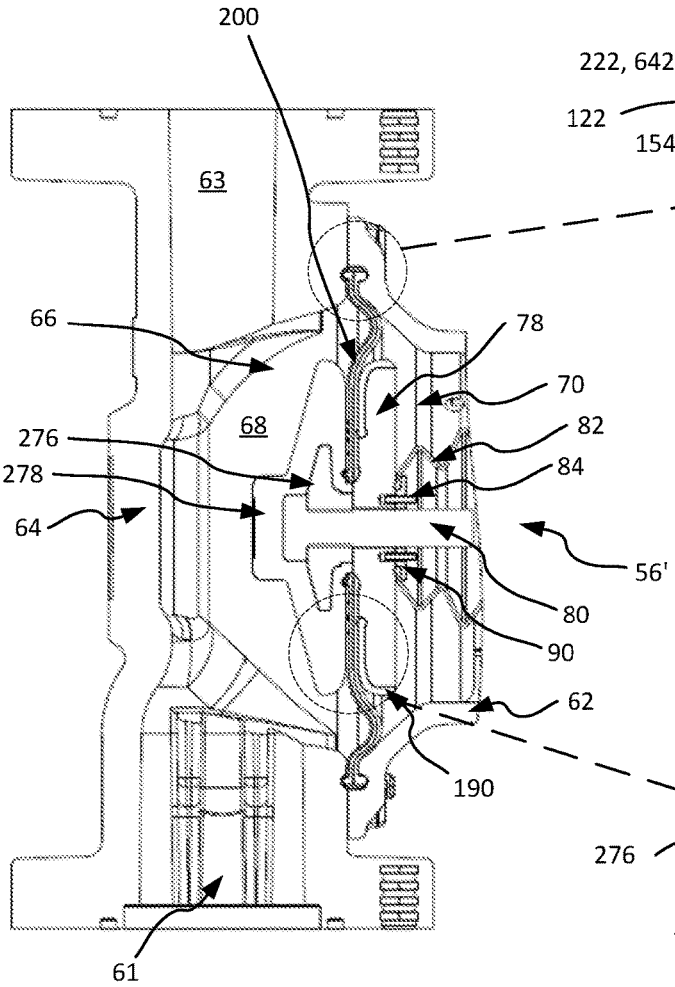
FIG. 10 depicts a side sectional view of another example embodiment of a pumping assembly that may be included in the diaphragm pump of FIG. 1.
Figure 13:
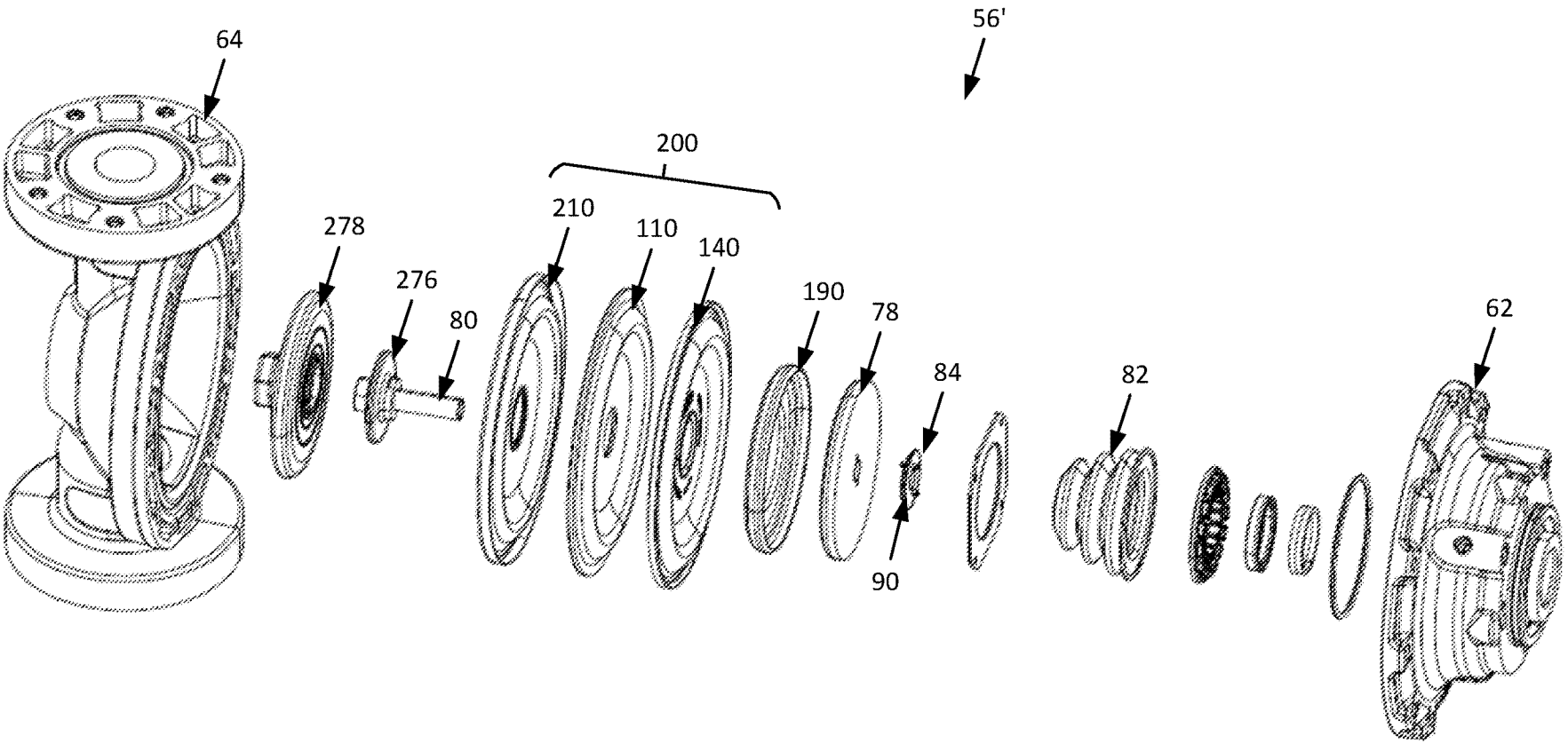
FIG. 13 depicts an exploded view of the pumping assembly of FIG. 10.
Figure 14:
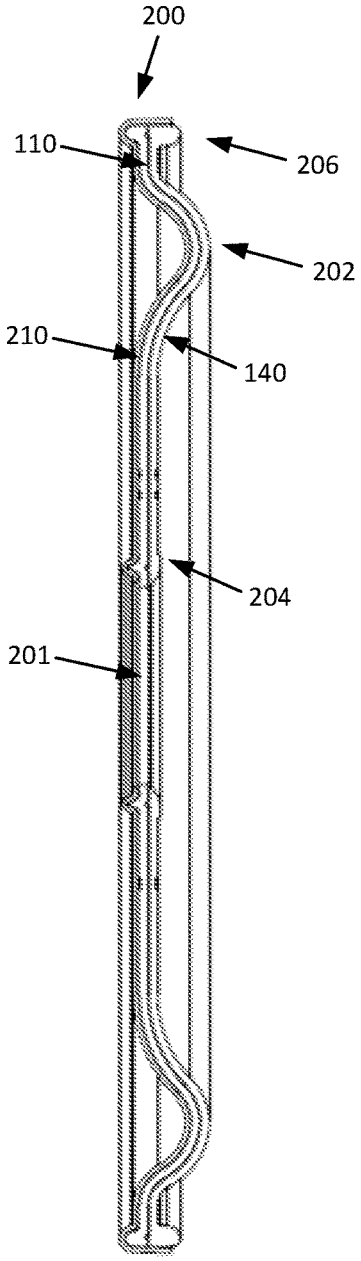
FIGS. 14 and 15 depict side views of a diaphragm included in the pumping assembly of FIG. 10, with layers of the diaphragm shown engaged in FIG. 14 and exploded in FIG. 15.
Figure 15:
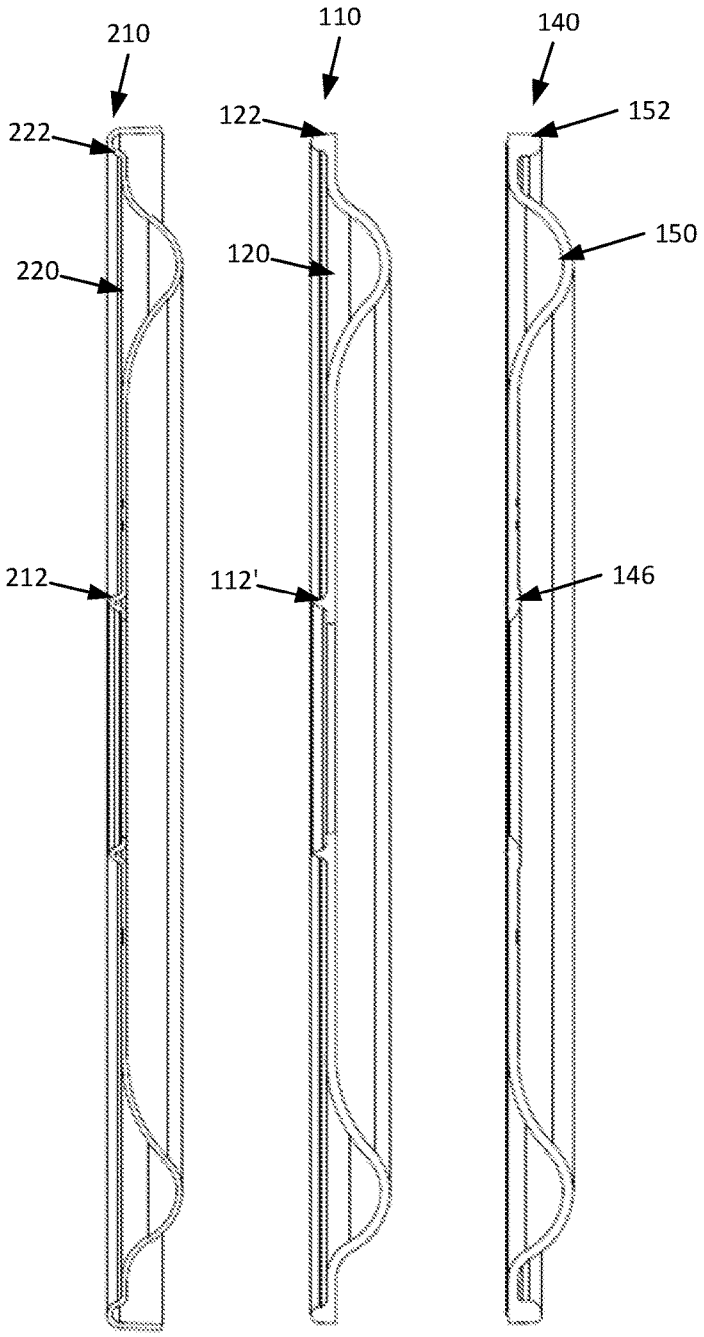

That said, the most notable components of pumping assembly 56' that differ from pumping assembly 56 are split-layer diaphragm 200 and fluid washer 276 (each of which can be seen clearly in the exploded view of FIG. 13). First, as can be seen in FIG. 10, the fluid washer 276 is similar to fluid washer 76 insofar as it works with backside washer 78 to sandwich and secure a split-layer diaphragm. However, now, the fluid washer 276 is encapsulated within a washer covering 278 that prevents the fluid washer 276 from being directly exposed to working fluid in the working fluid chamber 68. The fluid washer 276 still forms a metal-to-metal contact with the backside washer 78; however, the washer covering 278 also contacts backside washer 78 and extends entirely around the fluid washer 276 between its contact points with backside washer 78. In at least some embodiments, the washer covering 278 is formed from materials that can be used to form the third layer 210 of the split-layer diaphragm 200, which are described in detail below.

Second, the split-layer diaphragm 200 is similar to the split-layer diaphragm 100 in that it is an annular component that extends around a central opening 201, from an inner section 204 to an exterior section 206. However, now, the split-layer diaphragm 200 includes a third layer 210 disposed on a front side of the first layer 110, so that the first layer 110 is sandwiched between the third layer 210 and the second layer 140. Additionally, the split-layer diaphragm 200 is still non-planar; however, now the split-layer diaphragm 200 includes an inwardly cupping convolute 202 formed by the annular convolute 120 of the first layer 110, the annular convolute 150 of the second layer 140 and an annular convolute 220 of the third layer 210 (see FIG. 15).

In some embodiments, the third layer 210 is formed from a material suitable for handling fluid compatibility issues. For example, the third layer 210 may be formed from PTFE, a TPE, a TPV, such as Santoprene, or a thermoplastic polyester elastomer such as Hytrel to provide a range of compatibility suitable for various working fluids, including highly acidic fluids, highly basic fluids, and fluids with particulate contamination (e.g., ceramic particulate).

Then, the first layer 110 and the second layer 140 (or any number of layers disposed interiorly of the third layer 210) can provide strength for the split-layer diaphragm 200, such as via the constructions described above in connection with split-layer diaphragm 100 (e.g., by forming layers 110 and 140 from a 40D Santorpene). However, in the depicted embodiment, the first layer 110 and second layer 140 of the split-layer diaphragm 200 might have reduced thicknesses as compared to the constructions of split-layer diaphragm 100 (so that split-layer diaphragm 100 and split-layer diaphragm 200 can both fit within pumping assemblies 56 and 56' of identical dimensions). That said, in other embodiments, the thicknesses of first layer 110 and second layer 140 may vary based on the pump in which they are included, the number of layers included in split-layer diaphragm 200, or any other number of factors.

Figure 11:
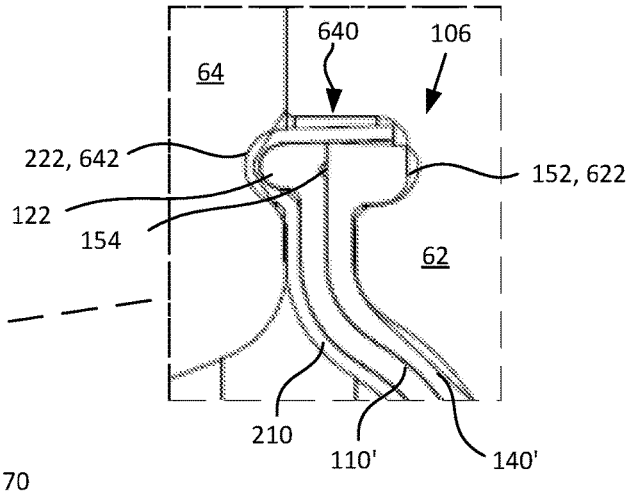
FIGS. 11 and 12 depict enlarged views of portions of the sectional view of FIG. 10.
Figure 12:
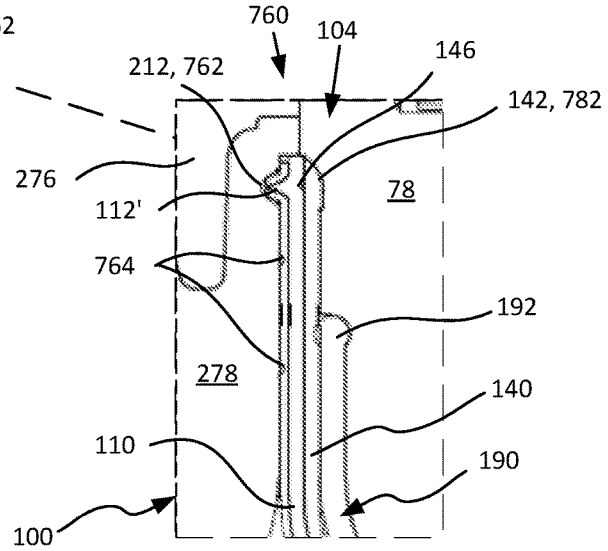

As can be seen in FIGS. 11 and 12, the split-layer diaphragm 200 is secured within glands 640 and 760 in a similar manner to split-layer diaphragm 100; however, now, the third layer 210 engages the front geometries of these glands. Specifically, as can be seen in FIG. 11, the third layer 210 includes an exterior cap 222 configured to extend over the exterior cap 122 of the split-layer diaphragm 100 in an arcuate manner. Thus, a rounded portion of the exterior cap 222 can be compressed into and seal against a V-shape defined by the front gland geometry 642 of the pump head 64. Additionally, the exterior cap 222 wraps around the exterior cap 122 and extends back over the tops of both the exterior cap 122 of the split-layer diaphragm 100 and the exterior cap 152 of the second layer 140. This may ensure that the third layer 210 covers any fluid incompatible layers of split-layer diaphragm 200 (e.g., layers 110 and 140) and protects these layers, as well as fluid washer 276, from damage (e.g., corrosion) that might be caused by a working fluid, such as a basic, acidic, or particulate carrying working fluid.

Meanwhile, as can be seen in FIG. 12, the third layer 210 includes an interior cap 212 configured to extend over the interior cap 112' of the split-layer diaphragm 100. In the depicted embodiment, the interior cap 112' is sharper than the interior cap 112 included in the embodiment of FIGS. 2-9 and, thus, may secure the first layer 110 to the third layer 210. Additionally, the interior cap 112' may compress the interior cap 212 of the third layer 210 into a V-shape defined by the front gland geometry 762 of the fluid washer 76. Thus, the interior cap 212 may seal interior gland 760 and protect the interior sections of first layer 110 and the third layer 210 from a potentially damaging fluid. In fact, in the depicted embodiment, the specific geometries of the interior cap 112' and the interior cap 212 may generate a high sealing pressure without requiring an excessive closing force, which may minimize the pre-load applied to the bolt 80 during assembly of the pumping assembly 56'.

Notably, in the depicted embodiment, both the interior gland 760 and the exterior gland 640 are each closed around the split-layer diaphragm 200 via metal-to-metal joints. That is, the interior and exterior sections 204, 206 of the split-layer diaphragm 200 are secured within their respective glands 640, 760 and do not extend out of their respective glands 640, 760 to be secured between the pump head 64 and base 62 or between washers 276 and 78. This avoids stressing the split-layer diaphragm 200 while also eliminating leakage issues that are encountered when a diaphragm material secured between metal components.

Figure 16:
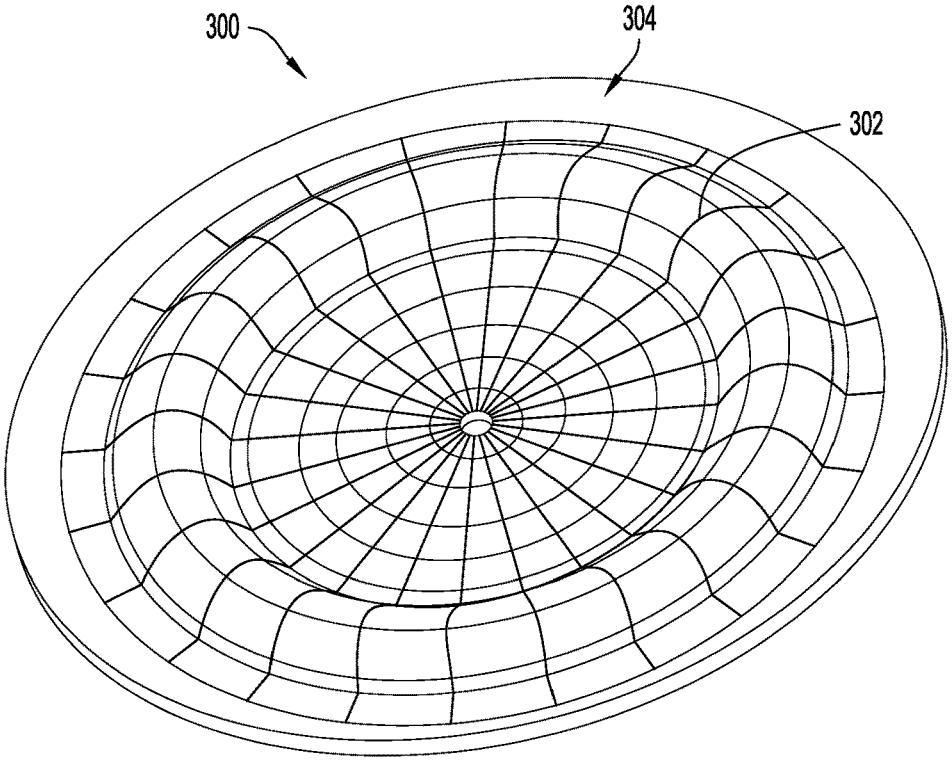
FIG. 16 depicts a perspective view of a first example embodiment of a reinforced composite layer that can be used as a layer of the split-layer diaphragm presented herein.
Figure 17:
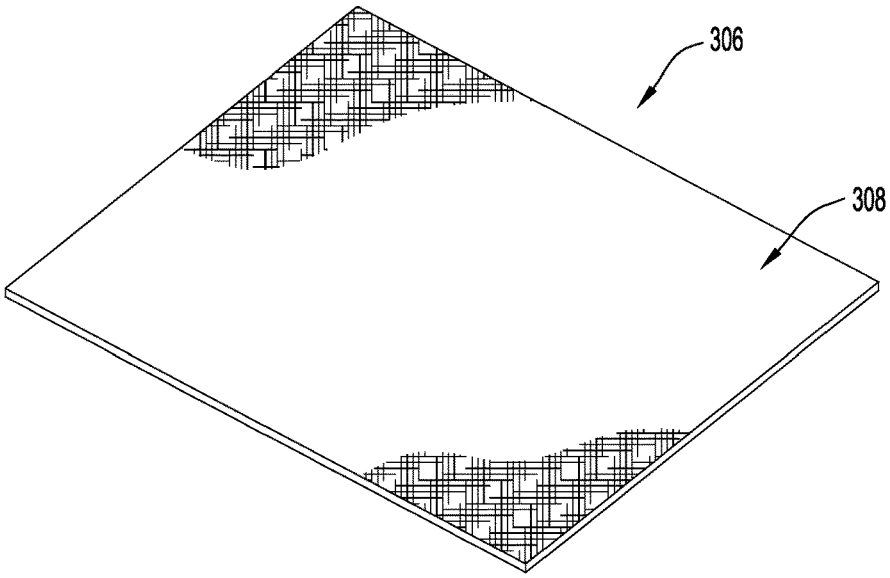
FIG. 17 depicts a perspective view of an example embodiment of a fabric that can be used in the reinforced composite layer of FIG. 16.
Figure 18:
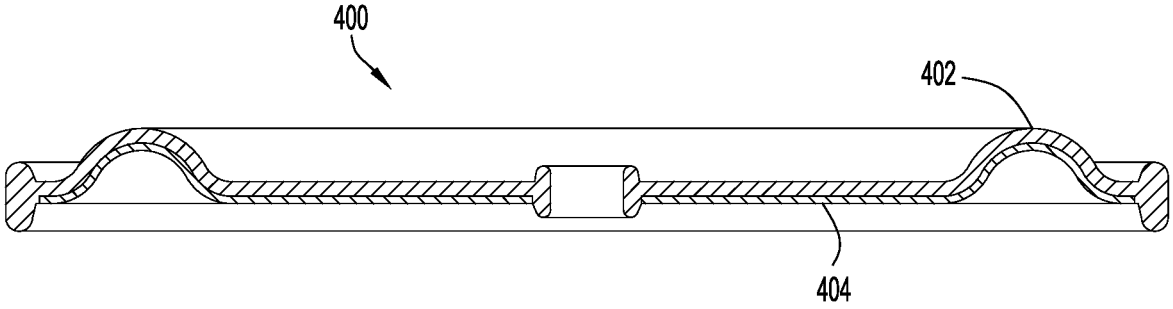
FIG. 18 depicts a perspective view of a second example embodiment of a reinforced composite layer that can be used as a layer of the split-layer diaphragm presented herein.

Now turning to FIGS. 16-18, as mentioned, in some embodiments, at least one layers of the split-layer diaphragms presented herein (e.g., layers 110 and 140) may be formed from multiple parts. For example, one or more layers of a split-layer diaphragm may be composite constructions formed from a reinforcement encapsulated within a matrix. The reinforcement can be a fabric or pseudo-fabric material and, in some forms, can be formed from two fabric or pseudo-fabric materials with offset weave patterns. An offset may provide improved stiffness in every direction as compared to a non-offset construction.

Generally, with the composite constructions presented herein, a reinforcement can be encapsulated within a matrix (e.g., a TPE/TPV material) via an injection molding process or compression molding process. Additionally or alternatively, the reinforcement can made of fabric, pseudo-fabric reinforcements, and/or a TPE material such as TPV and can be installed into a more elastic, lower modulus TPE/TPV's matrix. This may improve the resiliency of the matrix so that the composite construction can withstand larger pressure differentials, but without degrading the ability of the matrix material to respond to actuations of a pressure stroke.

Furthermore, in at least some embodiments, a fabric or pseudo-fabric reinforcement can be made of a material that is similar or bondable to the material used to form the matrix (e.g., overmolded TPE/TPV), which may be selected based on the specific application for which the split-layer diaphragm including the composite construction is intended. When the materials have a similar polymer chemistry, the materials can form a thermomechanical bond during a molding process (e.g., during an overmolding process). For example, a polypropylene (PP) fabric or pseudo-fabric reinforcement can be overmolded and encapsulated by a PP based TPV (e.g. Santoprene). The PP can be stiffer than the TPV thus acting like a net/support for the composite construction.

FIG. 16 illustrates a first example of a composite construction 300. In composite construction 300, a reinforcement 302 is arranged in a unique pattern within a matrix 304. Specifically, the reinforcement (e.g., a pseudo-fabric) is arranged in a spider web shape, radiating from a center. This strengthens the composite construction in a radial direction, which provides improved stiffness across the entire composite construction 300, instead of only stiffening specific areas of the construction (which may occur, for example, when a rectangular pattern applied to a circular layer). However, composite construction 300 is merely an example and, in various embodiments, the reinforcement 302 can be defined in any unique and/or uncommon patterns that are conducive for managing the stress profile experienced by a diaphragm.

Regardless of the specific pattern, a variety of materials can be used to ensure reinforcement 302 acts to reinforce the strength of the matrix 304 and these materials can be arranged in manner similar to how fabrics are woven. For example, when the reinforcement 302 is a fabric, the reinforcement can have any variety of woven characteristics such as a 2-D or 3-D woven fabrics, knitted fabrics, stitched fabrics, braids, nonwovens, and multiaxial fabrics. However, to achieve the strength reinforcement, the reinforcement 302 can be molded in this woven arrangement. Moreover, some embodiments may include one or more layers of reinforcement 302 (e.g., fabric and/or pseudo fabric). For example, in one non-limiting form two layers of fabric, with an offset of 45 degrees between the weave patter, can be stacked atop one another prior to a molding process.

Additionally or alternatively, the reinforcement 302 can be located at any variety of depths within the thickness of the matrix 304. For example, in some forms the reinforcement 302 extends through the matrix 304 in a position where a portion of the reinforcement 302 is located on one side of the composite construction 300 and another portion of the reinforcement 302 is located on the opposing side of the composite construction 300.

One example of a thermoplastic fabric is illustrated in FIG. 17. As can be seen, the thermoplastic fabric 306 may include a weave pattern 308 that resembles a weave pattern that may include in conventional fabrics and, thus, may have increased strength, at least as compared to a TPE. However, thermoplastic fabric 306 is merely one example material that may be used as reinforcement 302 and, regardless of the exact form of the reinforcement 302, the reinforcement 302 (e.g., fabric) can provide additional strength to the matrix 304 (e.g., TPE). Some specific examples of the composite strength layer include polypropylene (PP) and UHMWPE based fabrics bond with TPE and polyethylene terephthalate/polybutylene terephthalate (PET/PBT) based fabrics with copolyester elastomer (COPE) TPEs. Partially fluorinated fabrics bond with flexible polyvinylidene fluoride (PVDF) or Solmyra (Fluorinated TPE) available from Solvay of Bruxelles, Belgium, are also suitable materials.

Regardless of the exact composition, the composite construction 300 may, in some embodiments, be formed via an injection molding process. For example, the reinforcement 302 can be held in place via retracting core pins during a molding process to achieve a precise orientation within the matrix 304. Thus, processing the reinforcement 302 (e.g., fabric or pseudo-fabric) can include forming the reinforcement 302, placing the reinforcement 302 into a mold, capturing the reinforcement 302 within the mold with core pins, injecting the mold with the matrix 304 material, and curing the composite construction 300 prior to removal of the core pins. Alternatively, the core pins may be retained within the overmolded composite construction 300.

As another example, the composite construction 300 may, in some embodiments, be formed via a compression molding process. In such a process, the matrix 304 (e.g., TPE/TPV) can be extracted and clamped within a mold which also includes the reinforcement 302. Then, compressive pressure may be applied prior to removing the newly formed composite construction 300 from the mold.

Now turning to FIG. 18, another example composite layer 400 is formed by overmolding a first material 402 (i.e., matrix 402) over and around a layer of material 404 (i.e., reinforcement 404). Materials suitable for the construction illustrated in FIG. 18 can, in addition to those mentioned above, include polypropylene, polyethylene, polyamide, polycarbonate (PC,) acrylonitrile butadiene styrene (ABS), an ionomer resin such as Surlyn available from E.I. Du Pont De Nemours of Midland, Mich., and UHMWPE based laminates bond with TP. In addition, PET, PBT, PC+PBT alloy based laminates bond with COPE TPEs. Further, fluorinated polymers such as PVDF, tetrahydrocannabivarin (THV), ethylene chlorotrifluoroethylene (ECTFE), ethylene tetrafluoroethylene (ETFE), polychlorotrifluoroethylene (PCTFE), fluorinated ethylene propylene (FEP), or perfluoroalkoxy alkanes (PFA) laminates bond with flexible PVDF or Solmyra (Fluorinated TPE). Still yet further, thermoplastic polyurethanes, PVDF, THV, ECTFE, ETFE, PCTFE laminates bond with Capien (Fluorinated thermoplastic polyurethane (TPU)).

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow.

Additionally, in reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Furthermore, unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The invention claimed is:

1. A diaphragm pump comprising:

an inlet structured to receive a fluid;

an outlet structured to convey the fluid discharged by the diaphragm pump;

a pumping assembly disposed between the inlet and the outlet; and a split-layer diaphragm disposed within the pumping assembly and comprised of two or more unbonded, non-planar diaphragm layers that each extend radially from an inner section of the split-layer diaphragm to an exterior section of the split-layer diaphragm and travel together, the two or more unbonded, non-planar diaphragm layers comprising a first sealing feature protruding from the exterior section of the split-layer diaphragm, and a second sealing feature protruding from one of the two or more unbonded, non-planar diaphragm layers at the inner section of the split-layer diaphragm and pressing into an other of the two or more unbonded, non-planar diaphragm layers at the inner section of the split-layer diaphragm, wherein opposing faces of the two or more unbonded, non-planar diaphragm layers, the first sealing feature, and the second sealing feature form a sealed, fixed volume of closed space entirely within the split-layer diaphragm, and wherein the split-layer diaphragm is configured to flex in an intake direction to draw a working fluid into a pumping chamber defined by the split-layer diaphragm within the pumping assembly, and to flex in a discharge direction to expel the working fluid from the pumping chamber, wherein the closed space is free of lubricant and communicates pressure between the two or more unbonded, non-planar diaphragm layers so that the two or more unbonded, non-planar diaphragm layers travel together when the split-layer diaphragm flexes in the intake direction or the discharge direction, and wherein each diaphragm layer of the split-layer diaphragm comprises an inwardly cupping, annular convolute extending towards the intake direction, and the annular convolutes conform to one another to render the split-layer diaphragm non-planar and suitable for mechanical actuations.

2. The diaphragm pump of claim 1, further comprising:

a mechanical actuator configured to extend through a central interface of the split-layer diaphragm, the mechanical actuator being configured to flex the split-layer diaphragm in both the intake direction and the discharge direction so that air is not required on a suction side of the split-layer diaphragm.

3. The diaphragm pump of claim 1, wherein the first sealing feature comprises a first mating element extending from a face of the opposing faces of the two or more unbonded, non-planar diaphragm layers at the exterior section of the split-layer diaphragm.

4. The diaphragm pump of claim 3, wherein the second sealing feature comprises a second mating element, and the first mating element and the second mating element each comprise a bead.

5. The diaphragm pump of claim 3, wherein the first mating element is configured to press into an other face of the opposing faces of the two or more unbonded, non-planar diaphragm layers at the exterior section of the split-layer diaphragm.

6. The diaphragm pump of claim 1, wherein the two or more unbonded, non-planar diaphragm layers comprise:

two non-planar layers of equal thickness formed from a thermoplastic elastomer material.

7. The diaphragm pump of claim 6, wherein the two or more unbonded, non-planar diaphragm layers further comprise:

a third non-planar layer disposed exteriorly of the two non-planar layers of equal thickness so that the third non-planar layer is adjacent the pumping chamber, the third non-planar layer being structured to be in contact with the working fluid in the pumping chamber during operation of the diaphragm pump.

8. The diaphragm pump of claim 1, wherein at least one of the two or more unbonded, non-planar diaphragm layers is a composite construction including a reinforcement and a matrix material, the reinforcement comprising a fabric, a pseudo-fabric, or both.

9. The diaphragm pump of claim 1, wherein the two or more unbonded, non-planar diaphragm layers comprise:

a first non-planar layer structured to be in contact with the working fluid in the pumping chamber during operation of the diaphragm pump; and a second non-planar layer disposed interiorly of the first non-planar layer, so that the first non-planar layer is adjacent the pumping chamber, wherein the second non-planar layer is structured to carry a load associated with a differential pressure formed across the split-layer diaphragm during operation of the diaphragm pump that is higher than a load carried by the first non-planar layer.

10. The diaphragm pump of claim 9, wherein the second non-planar layer has a higher stiffness than the first non-planar layer.

11. The diaphragm pump of claim 9, wherein the first non-planar layer is one of a polytetrafluorethylene, thermoplastic, a thermoplastic vulcanizate, and a thermoplastic elastomer.

12. The diaphragm pump of claim 1, wherein the split-layer diaphragm is sandwiched between a fluid washer and a back washer, the diaphragm pump further comprising:

a washer pad disposed between the split-layer diaphragm and the back washer, the washer pad being structured to resist wear caused by relative movement of a back layer of the split-layer diaphragm and the back washer.

13. The diaphragm pump of claim 1, wherein the split-layer diaphragm is a first split-layer diaphragm, the pumping assembly is a first pumping assembly and the diaphragm pump further comprises:

a second split-layer diaphragm disposed within a second pumping assembly; and a third split-layer diaphragm disposed within a third pumping assembly.

14. A diaphragm structured for use in a diaphragm pump useful to pump a working fluid comprising:

a first non-planar layer extending radially from a first inner section to a first exterior section, the first non-planar layer defining a first inwardly cupping, annular convolute extending toward a first direction that corresponds to an intake direction for the diaphragm;

a second non-planar layer extending radially from a second inner section to a second exterior section, the second non-planar layer defining a second inwardly cupping, annular convolute extending toward the first direction and conforming to the first inwardly cupping, annular convolute;

a first sealing feature protruding from one of the first exterior section and the second exterior section; and a second sealing feature protruding form one of the first inner section and the second inner section and configured to press into an other of the first inner section and the second inner section;

wherein the second non-planar layer is independent from the first non-planar layer, but engaged to the first non-planar layer via the first sealing feature and the second sealing feature so that the first non-planar layer and the second non-planar layer form a sealed, fixed volume of closed space that is free of lubricant entirely within the diaphragm, and the closed space communicates pressure between the first non-planar layer and the second non-planar layer so that the first non-planar layer and the second non-planar layer travel together while flexing in the intake direction or a discharge direction within a pumping assembly.

15. The diaphragm of claim 14, wherein the first sealing feature comprises a first mating element extending from a face of opposing faces of the first non-planar layer and the second non-planar layer.

16. The diaphragm of claim 15, wherein the first mating element is configured to press into an other of the first exterior section and the second exterior section.

17. The diaphragm of claim 14, wherein the first non-planar layer and the second non-planar layer comprise two layers of equal thickness formed from a thermoplastic elastomer material.

18. The diaphragm of claim 17, further comprising:

a third non-planar layer disposed exteriorly of the first non-planar layer and the second non-planar layer, the third non-planar layer being structured to be in contact with the working fluid being pumped through the diaphragm pump.

19. The diaphragm of claim 14, wherein:

the first non-planar layer is formed from one of a polytetrafluorethylene, thermoplastic, a thermoplastic vulcanizate, and a thermoplastic elastomer and is structured to be in contact with the working fluid being pumped through the diaphragm pump; and the second non-planar layer is disposed interiorly of the first non-planar layer, so that the first non-planar layer is adjacent the working fluid, the second non-planar layer having a higher stiffness than the first non-planar layer so that the second non-planar layer carries a load associated with a differential pressure formed across the diaphragm during operation of the diaphragm pump that is higher than a load carried by the first non-planar layer.

20. The diaphragm of claim 14, wherein the second inwardly cupping, annular convolute substantially matches a curvature of the first inwardly cupping, annular convolute.

* * * * *